US008004473B2

(12) United States Patent
Chung et al.

(10) Patent No.: US 8,004,473 B2
(45) Date of Patent: Aug. 23, 2011

(54) ANTENNA DEVICE WITH AN ISOLATING UNIT

(75) Inventors: Shyh-Jong Chung, Hsinchu (TW); Ming Ta Lin, Yunlin County (TW); Chih Hung Tsai, Koahsiung (TW)

(73) Assignee: Realtek Semiconductor Corp., Hsinchu (TW)

( * ) Notice: Subject to any disclaimer, the term of this patent is extended or adjusted under 35 U.S.C. 154(b) by 334 days.

(21) Appl. No.: 12/244,562

(22) Filed: Oct. 2, 2008

(65) Prior Publication Data

US 2009/0091507 A1 Apr. 9, 2009

(30) Foreign Application Priority Data

Oct. 4, 2007 (TW) ..... 96137262 A

(51) Int. Cl.
*H01Q 1/52* (2006.01)

(52) U.S. Cl. ..... 343/841; 343/851

(58) Field of Classification Search ..... 343/835, 343/841, 893, 850, 851
See application file for complete search history.

(56) References Cited

U.S. PATENT DOCUMENTS 6,297,711 B1 * 10/2001 Seward et al. ..... 333/129
2008/0062058 A1 * 3/2008 Bishop ..... 343/835

OTHER PUBLICATIONS

Chi-Yuk Chiu et al., "Reduction of Mutual Coupling Between Closely Packed Antenna Elements", IEEE Transactions on Antennas and Propagation, vol. 55, No. 6, Jun. 2007, pp. 1732-1738.

* cited by examiner

*Primary Examiner* — Hoang V Nguyen
(74) *Attorney, Agent, or Firm* — Stephen A. Bent; Foley & Lardner LLP

(57) ABSTRACT

An antenna device includes a pair of antennas and an isolating unit. The antennas have the same operating frequency. The isolating unit is disposed between the antennas, and includes an LC circuit that has a resonant frequency, which is the same as the operating frequency of the antennas, thereby improving isolation between the antennas.

20 Claims, 5 Drawing Sheets

ANTENNA DEVICE WITH AN ISOLATING UNIT

CROSS-REFERENCE TO RELATED APPLICATION

This application claims priority of Taiwanese application no. 096137262, filed on Oct. 4, 2007.

BACKGROUND OF THE INVENTION

1. Field of the Invention

This invention relates to an antenna device, more particularly to an antenna device that includes an isolating unit.

2. Description of the Related Art

Wireless technology nowadays requires the existence of multiple antennas that operate in nearly the same frequency. For the purpose of miniaturization, the antennas are kept closely together which make them liable to mutual interferences. Hence, the isolation of the antennas is a problem yet to be solved.

Conventionally, an antenna device is isolated with a slit formed at the electrical ground. The slit generates inductance and capacitance, which generates a bandstop frequency.

The aforementioned conventional antenna device is disadvantageous in that it is not possible to replace the slit with any other LC circuit, which restricts modifications of all circuit elements. Moreover, the inductance generated by the slit is difficult to model. As such, the bandstop frequency generated by the slit will be very difficult to calculate. Further, the foregoing layout restrictions necessary for the conventional way of isolation requires a relatively larger physical area.

SUMMARY OF THE INVENTION

Therefore, the object of the present invention is to provide an antenna device that can overcome the aforesaid drawbacks of the prior art.

According to the present invention, an antenna device comprises at least a pair of antennas and an isolating unit. The antennas have substantially the same operating frequency. The isolating unit is disposed between the antennas, and includes an LC circuit that has a resonant frequency, which is substantially the same as the operating frequency of the antennas.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
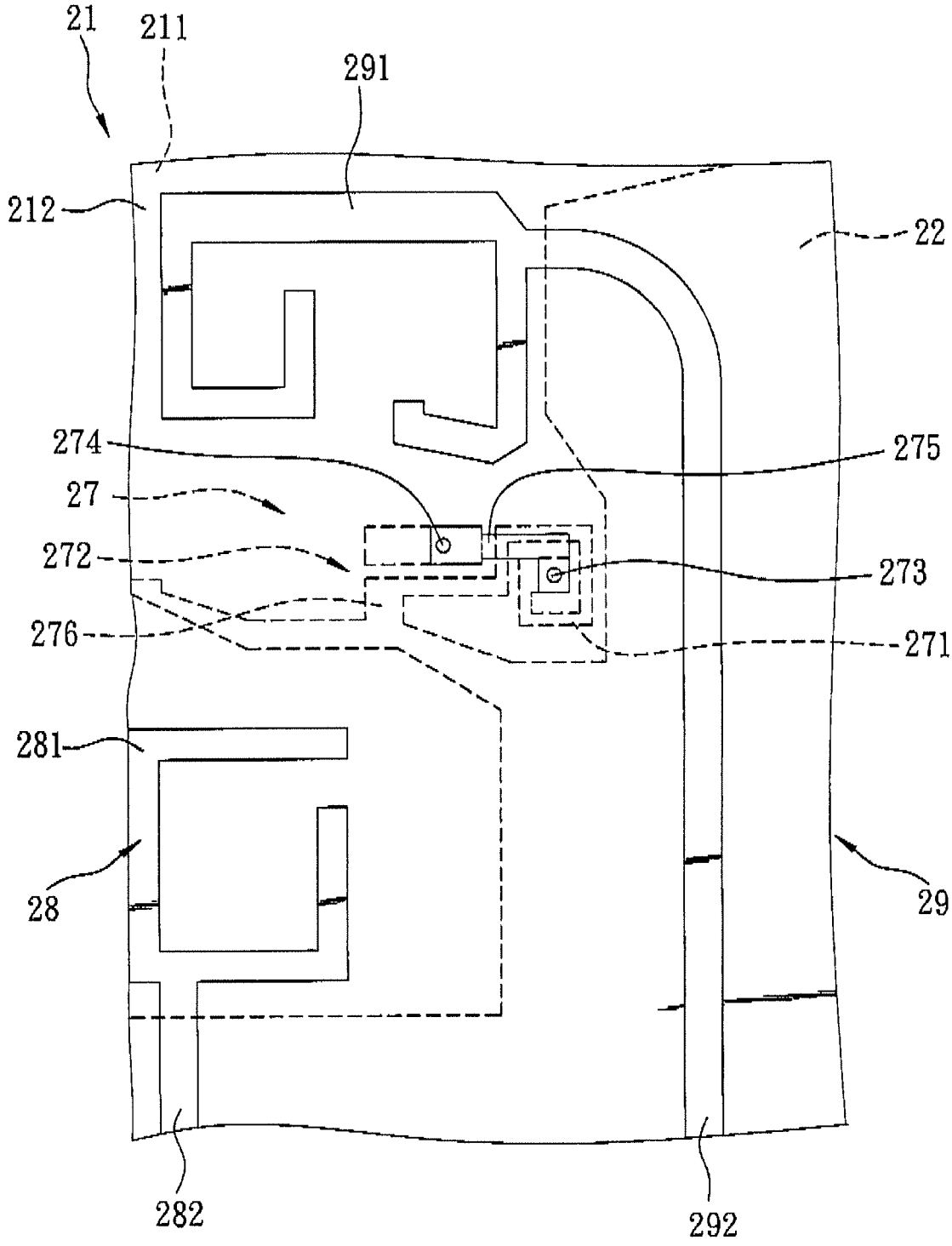
FIG. 1 is a schematic view of the first preferred embodiment of an antenna device according to the present invention.

Before the present invention is described in greater detail, it should be noted that like elements are denoted by the same reference numerals throughout the disclosure.

Figure 2:
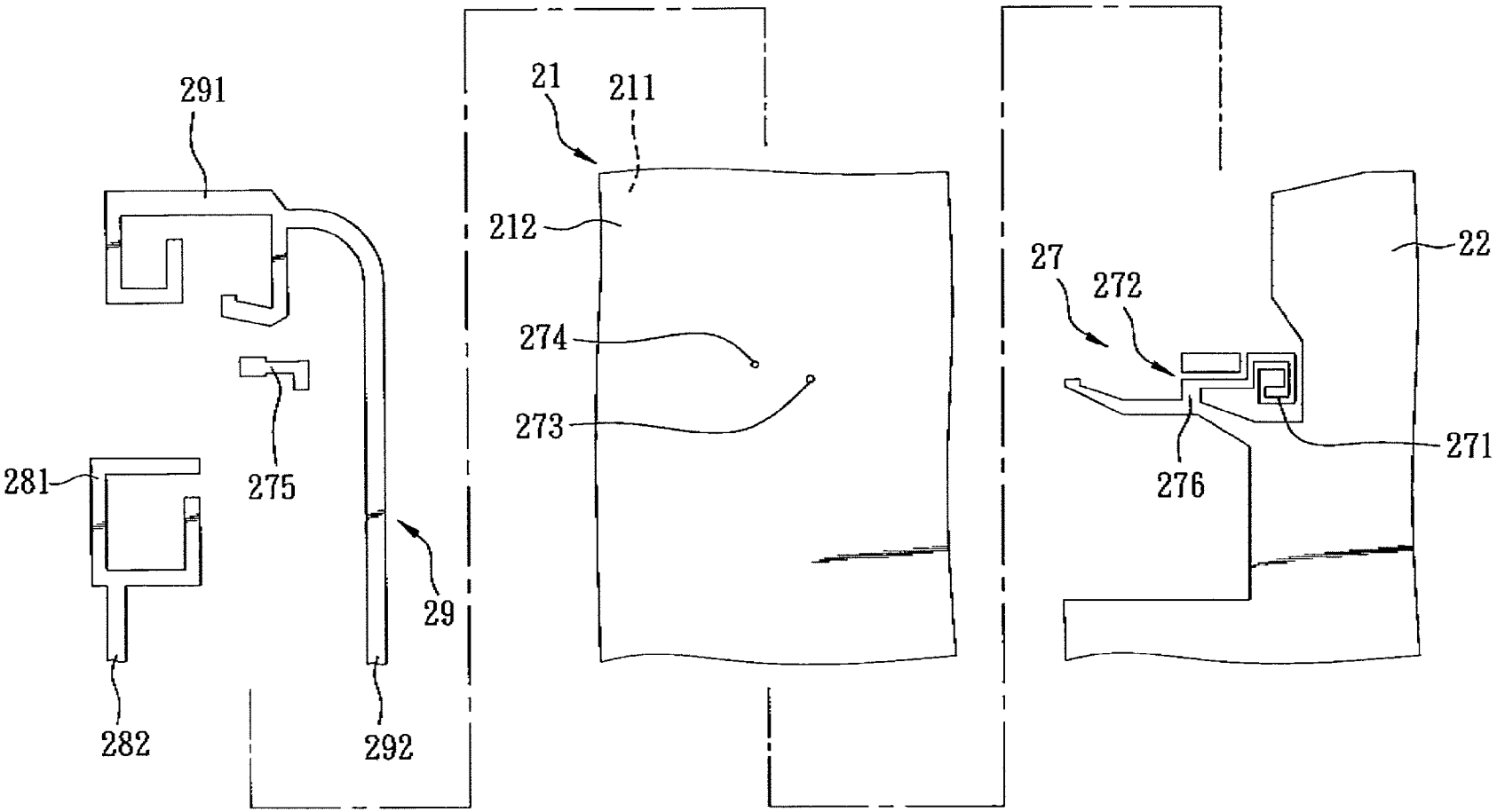
FIG. 2 is an exploded schematic view of the antenna device in FIG. 1.

Referring to FIGS. 1 and 2, the first preferred embodiment of an antenna device according to this invention is shown to include a pair of antennas 28, 29 and an isolating unit 27.

The antenna device further includes a dielectric substrate 21 that has opposite first and second surfaces 211, 212, and a grounding element 22 that is made from a conductive material and that is formed, such as by printing, on the first surface 211 of the dielectric substrate 21.

Each of the antennas 28, 29 includes a radiating element 281, 291 and a feeding line 282, 292. The radiating elements 281, 291, which are made from a conductive material, are formed such as by printing on the second surface 212 of the dielectric substrate 21, and do not overlap the grounding element 22. The feeding lines 282, 292, which are made from a conductive material, are formed such as by printing on the second surface 212 of the dielectric substrate 21. The feeding lines 282, 292 are respectively connected to the radiating elements 281, 291, and overlap the grounding element 22. In this embodiment, the radiating elements 281, 291 of the antennas 28, 29 have substantially the same operating frequency.

The isolating unit 27 is made from a conductive material and is disposed between the radiating elements 281, 291 of the antennas 28, 29. The isolation unit 27 includes an LC circuit and first and second connecting lines 275, 276. In this embodiment, the LC circuit is formed, such as by printing, on the first surface 211 of the dielectric substrate 21. The LC circuit has a resonant frequency that is substantially the same as the operating frequency of the radiating elements 281, 291 of the antennas 28, 29, and includes a spiral inductor 271 and a gap capacitor 272, each of which has first and second terminals. The first terminal of the spiral inductor 271 is connected to the first terminal of the gap capacitor 272. The second connecting line 276 is formed on the first surface 211 of the dielectric substrate 21, and interconnects a junction of the first terminals of the spiral inductor 271 and the gap capacitor 272, and the grounding element 22. The first connecting line 275 is formed on the second surface 212 of the dielectric substrate 21. The second terminal of the spiral inductor 271 is connected to the first connecting line 275 through a via 273. The second terminal of the gap capacitor 272 is connected to the first connecting line 275 through a via 274.

In an alternative embodiment, the spiral inductor 271 and the gap capacitor 272 may be formed on the second surface 212 of the dielectric substrate 21. Moreover, the shapes of the spiral inductor 271, the gap capacitor 272, and the radiating elements 281, 291 may be varied. Further, the spiral inductor 271, the gap capacitor 272, and the radiating elements 281, 291 may be replaced by a lumped inductor, a lumped capacitor, and a chip antenna element, respectively.

It is noted that the spiral inductor 271 achieves a larger inductance when compared to other kinds of inductors having substantially the same physical size. Moreover, the spiral inductor 271 is relatively easy to model. As such, the resonant frequency of the LC circuit of the isolating unit 27 may be easily calculated. Further, the LC circuit of the isolating unit 27 oscillates at the resonant frequency when excited by the radiating elements 282, 291 of the antennas 28, 29. As such, isolation between the radiating elements 281, 291 is significantly improved. In addition, the greater the radiating strength of the radiating elements 281, 291, the better the isolation between the radiating elements 281, 291. It should also be noted that the location of the isolating unit 27 may be determined by the radiating strength in various directions of the antennas 28, 29.

Figure 3:
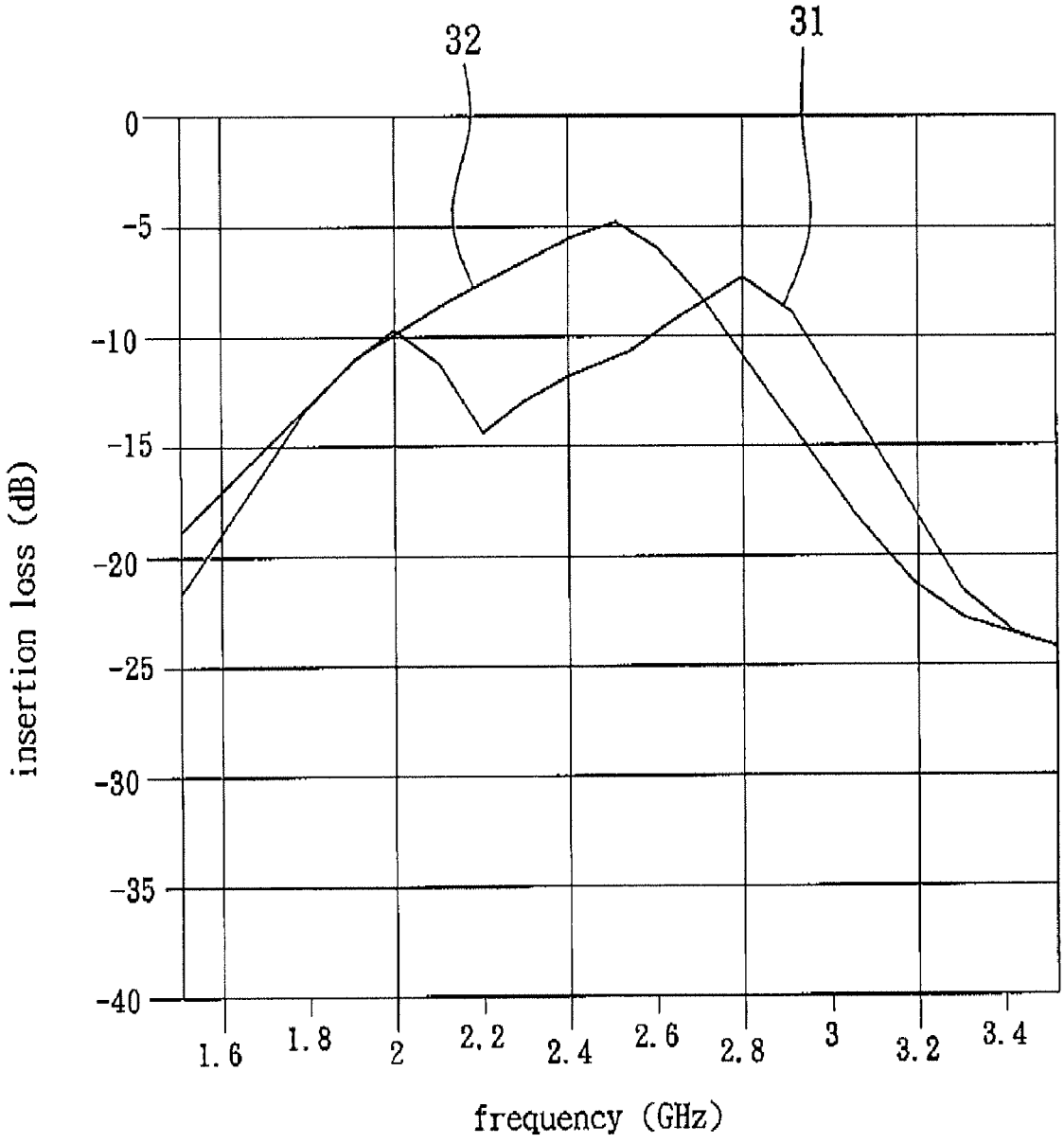
FIG. 3 is a plot illustrating insertion losses of the first preferred embodiment.

FIG. 3 illustrates the insertion losses of the antenna device of this invention. In FIG. 3, lines 31 and 32 indicate the insertion losses of the antenna device, respectively, with and without the isolating unit 27.

Figure 4:
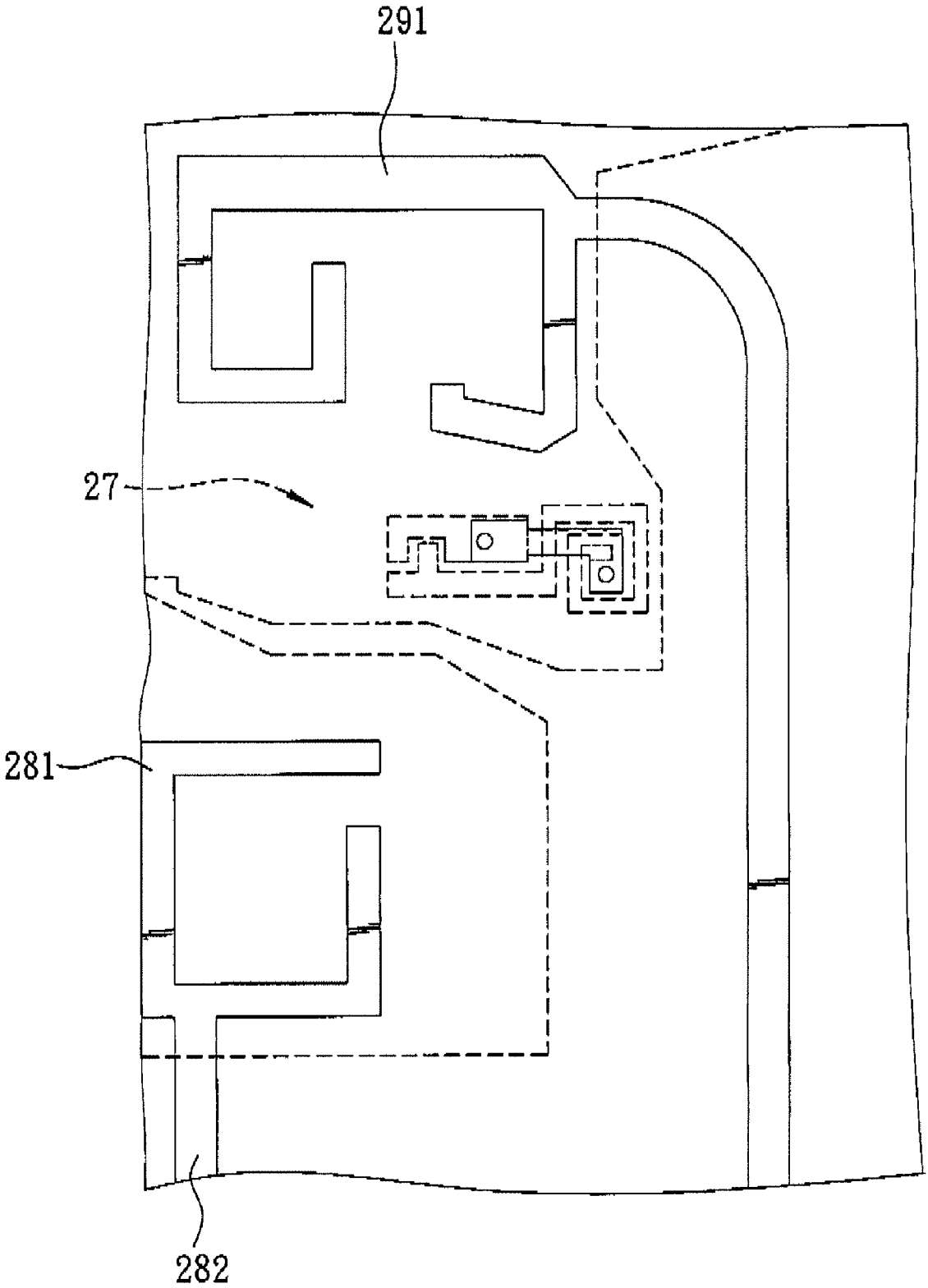
FIG. 4 is a schematic view of the second preferred embodiment of an antenna device according to the present invention.

FIG. 4 illustrates the second preferred embodiment of an antenna device according to this invention. When compared to the previous embodiment, the second connecting line 276 (see FIG. 1) of the isolating unit 27 is dispensed with. This further improves the isolation between the radiating elements 281, 291, but compromises the bandwidth of the radiating elements 281, 291.

Figure 5:
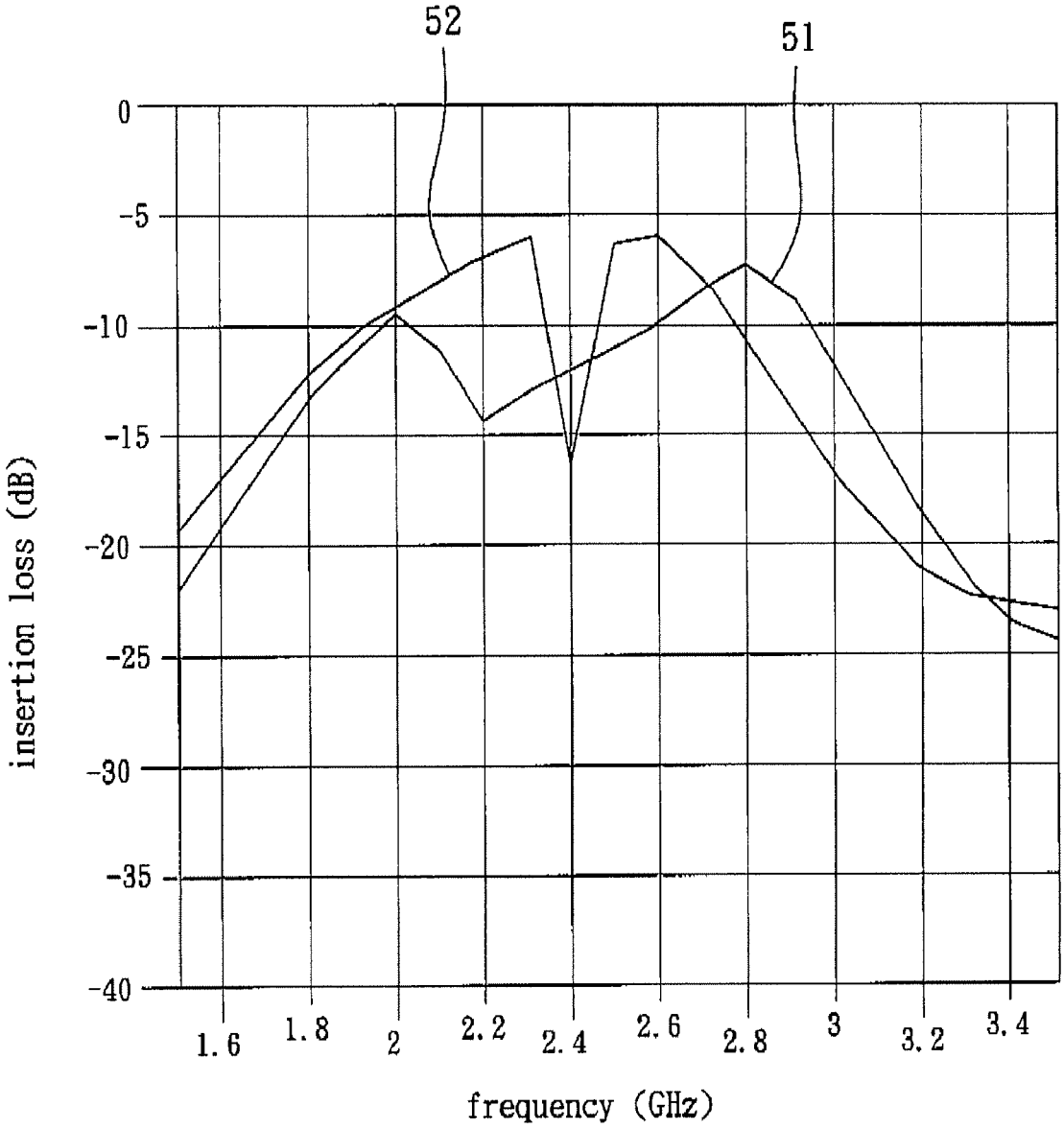
FIG. 5 is a plot illustrating insertion losses of the second preferred embodiment.

FIG. 5 illustrates the insertion losses of the antenna device of this invention. In FIG. 5, lines 51, 52, indicate the insertion losses of the antenna device, respectively, with and without the second connecting line 276 of the isolating unit 27.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna device, comprising:

at least a pair of antennas having substantially the same operating frequency; and an isolating unit disposed between said pair of antennas, and including an LC circuit that has a resonant frequency, which is substantially the same as the operating frequency of said pair of antennas, wherein said LC circuit is disposed between said pair of antennas without forming an electrical connection between said pair of antennas via said LC circuit, thereby to effect isolation between said pair of antennas.

2. The antenna device as claimed in claim 1, wherein said LC circuit of said isolating unit is grounded.

3. The antenna device as claimed in claim 1, further comprising a dielectric substrate having opposite first and second surfaces, each of said antennas including a radiating element formed on said second surface of said dielectric substrate, and a feeding line formed on said second surface of said dielectric substrate and coupled to said radiating element.

4. The antenna device as claimed in claim 3, wherein said radiating element of at least one of said pair of antennas is a chip antenna element.

5. The antenna device as claimed in claim 3, wherein said LC circuit oscillates at the resonant frequency when excited by said radiating element of each of said pair of antennas.

6. The antenna device as claimed in claim 3, wherein a location of said isolating unit is determined by a directional radiating strength of said pair of antennas.

7. The antenna device of claim 1, wherein said LC circuit includes one of a spiral inductor, a gap capacitor, or a lumped inductor.

8. The antenna device of claim 7, wherein said LC circuit comprises:

a spiral inductor; and a gap capacitor, wherein the spiral inductor and the gap capacitor each comprise a first terminal and a second terminal, and wherein the isolation unit further includes a single connecting line connected to the second terminal of the spiral inductor and the second terminal of the gap capacitor.

9. An antenna device comprising:

at least a pair of antennas having substantially the same operating frequency;

an isolating unit disposed between said pair of antennas, and including an LC circuit that has a resonant frequency, which is substantially the same as the operating frequency of said antennas, wherein said LC circuit of said isolating unit is grounded; and a dielectric substrate having opposite first and second surfaces, wherein each of the pair of antennas comprises a radiating element formed on said second surface of said dielectric substrate and a feeding line formed on said second surface of said dielectric substrate and coupled to said radiating element, and wherein said LC circuit of said isolating unit is formed on said first surface of said dielectric substrate.

10. The antenna device as claimed in claim 9, further comprising a grounding element formed on said first surface of said dielectric substrate, said LC circuit of said isolating unit being connected to said grounding element.

11. The antenna device as claimed in claim 9, wherein said LC circuit is printed on said first surface of said dielectric substrate.

12. The antenna device of claim 9, wherein said LC circuit oscillates at the resonant frequency when excited by said radiating element of each of said pair of antennas.

13. The antenna of claim 9, wherein a location of said isolating unit is determined by a directional radiating strength of said pair of antennas.

14. An antenna device comprising:

at least a pair of antennas having substantially the same operating frequency;

an isolating unit disposed between said pair of antennas, and including an LC circuit that has a resonant frequency, which is substantially the same as the operating frequency of said antennas, wherein said LC circuit of said isolating unit is grounded; and a dielectric substrate having opposite first and second surfaces, wherein each of the pair of antennas comprises a radiating element formed on said second surface of said dielectric substrate and a feeding line formed on said second surface of said dielectric substrate and coupled to said radiating element, and wherein said radiating element of each of said antennas is printed on said second surface of said dielectric substrate.

15. The antenna device of claim 14, wherein said LC circuit oscillates at the resonant frequency when excited by said radiating element of each of said pair of antennas.

16. The antenna of claim 14, wherein a location of said isolating unit is determined by a directional radiating strength of said pair of antennas.

17. An antenna device, comprising:

at least a pair of antennas having substantially the same operating frequency; and an isolating unit disposed between said pair of antennas, and including an LC circuit that has a resonant frequency, which is substantially the same as the operating frequency of said antennas, wherein said LC circuit includes one of a spiral inductor, a gap capacitor, or a lumped inductor.

18. The antenna device as claimed in claim 17, wherein said LC circuit comprises:

a spiral inductor; and a gap capacitor, wherein the spiral inductor and the gap capacitor each comprise a first terminal and a second terminal, and wherein the isolation unit further includes a first connecting line connected to the second terminal of the spiral inductor and the second terminal of the gap capacitor.

19. The antenna device of claim 18, wherein the isolation unit further comprises a second connecting line interconnecting a junction of the first terminal of the spiral inductor and the gap capacitor.

20. The antenna device of claim 18, wherein said first connecting line is the only connecting line of the isolation unit.

* * * * *